United States Patent [19]

Gross

[11] 4,153,859

[45] May 8, 1979

[54] TRAVELLING WAVE TUBE WITH A HELICAL DELAY LINE

[75] Inventor: Franz Gross, Munich, Fed. Rep. of Germany

[73] Assignee: Siemens Aktiengesellschaft, Berlin & Munich, Fed. Rep. of Germany

[21] Appl. No.: 840,494

[22] Filed: Oct. 7, 1977

[30] Foreign Application Priority Data

Dec. 6, 1976 [DE] Fed. Rep. of Germany ... 7638159[U]

[51] Int. Cl.[2] ..... H01J 25/34

[52] U.S. Cl. ..... 315/3.5; 315/3.6; 315/37.3

[58] Field of Search ..... 315/3.5, 3.6, 39.3

[56] References Cited

U.S. PATENT DOCUMENTS

| | | | |
|---|---|---|---|
| 2,947,907 | 8/1960 | Bodmer | 315/3.5 |
| 3,634,723 | 1/1972 | Gross | 315/3.5 |
| 3,903,449 | 9/1975 | Scott et al. | 315/3.5 |

*Primary Examiner*—Saxfield Chatmon, Jr.
*Attorney, Agent, or Firm*—Hill, Gross, Simpson, Van Santen, Steadman, Chiara & Simpson

[57] ABSTRACT

A travelling-wave tube with improved heat dissipation characteristics, having a helical delay line disposed between an electron-beam generating system and an electron-beam receiver, with the helical delay line being supported by a plurality of retaining members, at least one of which is made out of a material different from the remaining members, the latter being made out of quartz and the first mentioned member being made of a material that has a better heat conducting capacity than the quartz rods, at least in radial direction, and has a dielectric constant that does not differ sufficiently from that of quartz to materially effect the gain of the tube or dispersion curve of the signal wave.

3 Claims, 1 Drawing Figure

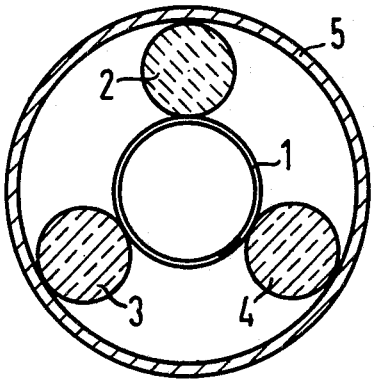
5
2
1
3
4

TRAVELLING WAVE TUBE WITH A HELICAL DELAY LINE

BACKGROUND OF THE INVENTION

The invention relates to a travelling-wave tube having a helical delay line, i.e. a helix, disposed between an electron-beam generating system and an electron-beam receiver with the helix being supported by a plurality of retaining members, for example of rod-like configuration, made of dielectric material and extending parallel with the helix, at least one retaining rod being made of a different material than that of the remaining retaining rods. Such a tube is generally known, for example, from German Inspection Specification 2,029,093.

The retaining rods frequently are constructed of quartz as such material has a relatively small dielectric constant ($\epsilon \approx 3.6$), and consequently makes possible a high coupling resistance. However, quartz is a relatively poor heat conductor and as a result often the quartz-mounted molybdenum or tungsten helices, even in medium power tubes, are heated on the output side to such high temperatures, from natural losses and by impinging electrons, that irregularities occur on the helix structure and the saturation power falls off appreciably. Additionally, reflection points and parasitic attenuation zones can arise at the tube output, in particularly where copper or gold plated helices are employed resulting from evaporation and metal vapour precipitation on the dielectric rods, leading to a failure of the tube.

BRIEF SUMMARY OF THE INVENTION

The invention is directed to a construction, in a tube of the type referred to, in which, by relatively very simple means, the described heat-power losses and functional failures may be prevented. This is accomplished in accordance with the invention by utilizing with quartz retaining rods, at least one rod which is constructed of a material having better thermal conduction than quartz rods, at least in a radial direction. By the utilization of such a supporting arrangement, the heat loss is dissipated more efficiently from the helix to the adjacent tube wall than when utilizing supporting rods only of quartz. In particular, the tube is less inclined to so-called "fading", the disadvantageous drop in power during operation.

Expediently, rods, suitable for use with quartz rods, may be constructed either of beryllium oxide or boron nitride. Beryllium oxide does not convey heat as well at fairly high operating temperatures, while the heat conduction behaviour of boron nitride is independent of the temperature and at about 800° has much the same high value as that of beryllium oxide. Surprisingly, in spite of anisotropic heat elimination in the peripheral direction, the line is uniformly tempered beyond expectation and exhibits no deformation of any sort. It would appear clear that it is sufficient for every coil of the helix to come into contact with a relatively good heat conductor at a single point.

Dielectric materials such as beryllium oxide and boron nitride not only conduct heat well but also have a greater dielectric constant than quartz, as a result of which the helix is unevenly loaded electrically, a situation which explains the reluctance found in expert circles with respect to helix mountings employing rods of different materials. Undoubtedly, a rod with a fairly high $\epsilon$ reduces the coupling resistance and must have an effect on the transmission characteristic. However, measurements have proved that by replacing one of three quartz rods with a BeO rod, the gain is reduced merely by about 5 to 10%, and the dispersion curve for the signal wave is not changed in itself but rather merely somewhat displaced overall.

In the inspection specification mentioned at the start the retaining rods with a different $\epsilon$ were employed, but in this case, the use of such retaining rods was directed specifically to the suppression of the backward travelling first spatial harmonic, giving rise to disturbing waves by pronounced unsymmetrical capacitive helix loading. To achieve this result, widely divergent dielectric constants are needed, in view of which, a combination of materials comprising beryllium oxide and konstite was proposed in the literature referred to. The dielectric constant of BeO is about 6.7, while that of konstite is between 25 and 30.

BRIEF DESCRIPTION OF THE DRAWINGS

In the drawing, the FIGURE illustrates, in a highly schematic manner, the longitudinal cross-section of a portion of a travelling-wave tube, i.e. the interaction section containing the helix.

DESCRIPTION OF A PREFERRED FORM OF THE INVENTION

Referring to the drawing, the helix 1 is supported by three retaining rods 2, 3 and 4, which extend along the helix within a vacuum enclosure 5 which is concentric with the helix. The latter is constructed of molybdenum, while the retaining rod 2 is of beryllium oxide, and the two remaining rods 3 and 4 are of quartz. The casing may be made of suitable material as for example copper.

While the proposed tube, when compared with a structure employing a three quartz rods, has a somewhat lower coupling resistance, it is less susceptible to disturbing waves and, in particular, is distinguished by a very stable operation over long periods.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A travelling-wave tube with improved heat dissipation characteristics, having a helical delay line disposed between an electron-beam generating system and an electron-beam receiver, with the helix being supported by three retaining rods made of dielectric material extending parallel thereto, one of said retaining rods being made of a material different from that of the remaining rods, said remaining rods being constructed of quartz, while the firstmentioned different kind of rod is constructed of a material that has a better heat conducting capacity than the quartz rods, at least in a radial direction, and has a dielectric constant which does not differ sufficiently from that of quartz to materially effect the gain of the tube or dispersion curve of the signal wave.

2. A travelling-wave tube according to claim 1, wherein such different rod is constructed of beryllium oxide.

3. A travelling-wave tube according to claim 1, wherein such different rod is constructed of boron nitride.

* * * * *